US009087464B2

(12) United States Patent
Presswood, Jr. et al.

(10) Patent No.: US 9,087,464 B2
(45) Date of Patent: Jul. 21, 2015

(54) DECORATIVE LIGHT DISPLAY

(75) Inventors: Ronald G. Presswood, Jr., Houston, TX (US); Selby Sullivan, Oviedo, FL (US)

(73) Assignee: BALB, LLC, Houston, TX (US)

( * ) Notice: Subject to any disclaimer, the term of this patent is extended or adjusted under 35 U.S.C. 154(b) by 192 days.

(21) Appl. No.: 13/159,788

(22) Filed: Jun. 14, 2011

(65) Prior Publication Data

US 2011/0305849 A1 Dec. 15, 2011

Related U.S. Application Data

(60) Provisional application No. 61/354,545, filed on Jun. 14, 2010.

(51) Int. Cl.

| | |
|---|---|
| ***G09F 13/22*** | (2006.01) |
| ***A47G 33/08*** | (2006.01) |
| ***B44C 5/00*** | (2006.01) |

(52) U.S. Cl.

CPC ..... *G09F 13/22* (2013.01); *A47G 33/08* (2013.01); *B44C 5/00* (2013.01)

(58) Field of Classification Search

USPC ..... 40/544; 362/249.06; 428/8

See application file for complete search history.

(56) References Cited

U.S. PATENT DOCUMENTS

| | | | | |
|---|---|---|---|---|
| 2,616,199 | A * | 11/1952 | Robins | 428/9 |
| 2,868,568 | A * | 1/1959 | Frye | 403/171 |
| 6,017,132 | A * | 1/2000 | Miller et al. | 362/249.16 |

* cited by examiner

*Primary Examiner* — Joanne Silbermann

(74) *Attorney, Agent, or Firm* — Morgan, Lewis & Bockius LLP

(57) ABSTRACT

A decorative light display used with a decorative string of lights comprises an inner and an outer flexible circular-shaped substructure, the flexible substructures including a pair of interlocking notches allowing the substructures to be assembled together to form a generally spherically shaped framework; the substructures having inner and outer circumferences, wherein the notches are formed on the inner circumference of the outer flexible substructure and the outer circumference of the inner flexible substructure; further comprising a sinusoidal wave shape formed on the outer circumferences of the flexible substructures for securing the decorative string of lights in contact therewith.

21 Claims, 8 Drawing Sheets

DECORATIVE LIGHT DISPLAY

CROSS REFERENCE TO RELATED APPLICATIONS

This application is a continuation of provisional application Ser. No. 61/354,545 filed Jun. 14, 2010, incorporated by reference herein.

BACKGROUND

1. Field of the Invention

This invention relates to decorative light displays, and more particularly, to a decorative light display that accepts stranded light sets and is easily repaired, assembled and disassembled.

2. Description of the Related Art

Current decorative light displays or designs are made to hold individual light strands in spherical, star or other shapes, such as a reindeer or a Christmas tree. Known designs may be made of a solid material with a light placed internally that illuminates the outer surface. Other displays are generally made of a solid framework, with the lights disposed in a string or strand wrapped around the periphery thereof.

Grapevines are also used in decorative light displays. Grapevines are collected from a vineyard, wrapped in the shape of a ball, and dried. Strings of lights are clipped or otherwise attached to the surface of the resulting ball. Grapevine balls, of course, pose a significant fire hazard, are particularly expensive, as they require a substantial investment in labor in the construction thereof, and involve an increased cost relating to the clips used to attach the lights to the ball.

Styrofoam balls are also utilized as the foundation upon which light strands are attached. Styrofoam ball light displays must have the lights disposed on the exterior surface thereof, and are unable to have a light disposed in the interior. Thus, styrofoam balls cannot be used to form lamp-like structures. As noted above with respect to grapevine balls, additional costs are also associated with the clips needed to attach the lights to the ball.

Rigid metal hoops are also assembled to form frameworks upon which light strands may be draped. Such hoops are quite heavy and are relatively expensive, as extensive metal fabrication is required to make the hoops. The outer circumference of known metal displays is smooth. The smooth outer circumference permits the light strands wrapped thereon to slide off or dangle freely, thus creating an unattractive appearance.

It is often difficult to transport and store known displays to and from storage, as they are frequently large and delicate, requiring great care in handling. In addition, large, uneconomical spaces are needed to store such displays when not being used.

It is difficult to repair or replace lights in the light string of known decorative light displays, as the light strands disposed thereon often become tangled.

SUMMARY OF THE INVENTION

In accord with the present invention, a display used with a decorative string comprises a plurality of flexible substructures. The flexible substructures include an interlocking mechanism allowing the substructures to be assembled together to form a framework. The flexible substructures further include a wavy surface holding the decorative string in contact therewith.

Further in accord with the present invention, a decorative light display used with a decorative light string comprises an inner flexible substructure, a middle flexible substructure, and an outer flexible substructure. The flexible substructures include an interlocking mechanism allowing the substructures to be assembled together to form a framework. The flexible substructures support the decorative light string in contact therewith.

Still further in accord with the present invention, a decorative light display used with a decorative string of lights comprises an inner and an outer flexible circular-shaped substructure. The flexible substructures include a pair of interlocking notches allowing the substructures to be assembled together to form a generally spherically shaped framework. The substructures have inner and outer circumferences, wherein the notches are formed on the inner circumference of the outer flexible substructure and the outer circumference of the inner flexible substructure. A sinusoidal wave shape is formed on the outer circumferences of the flexible substructures for securing the decorative string of lights in contact therewith.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figures 1, 1A:
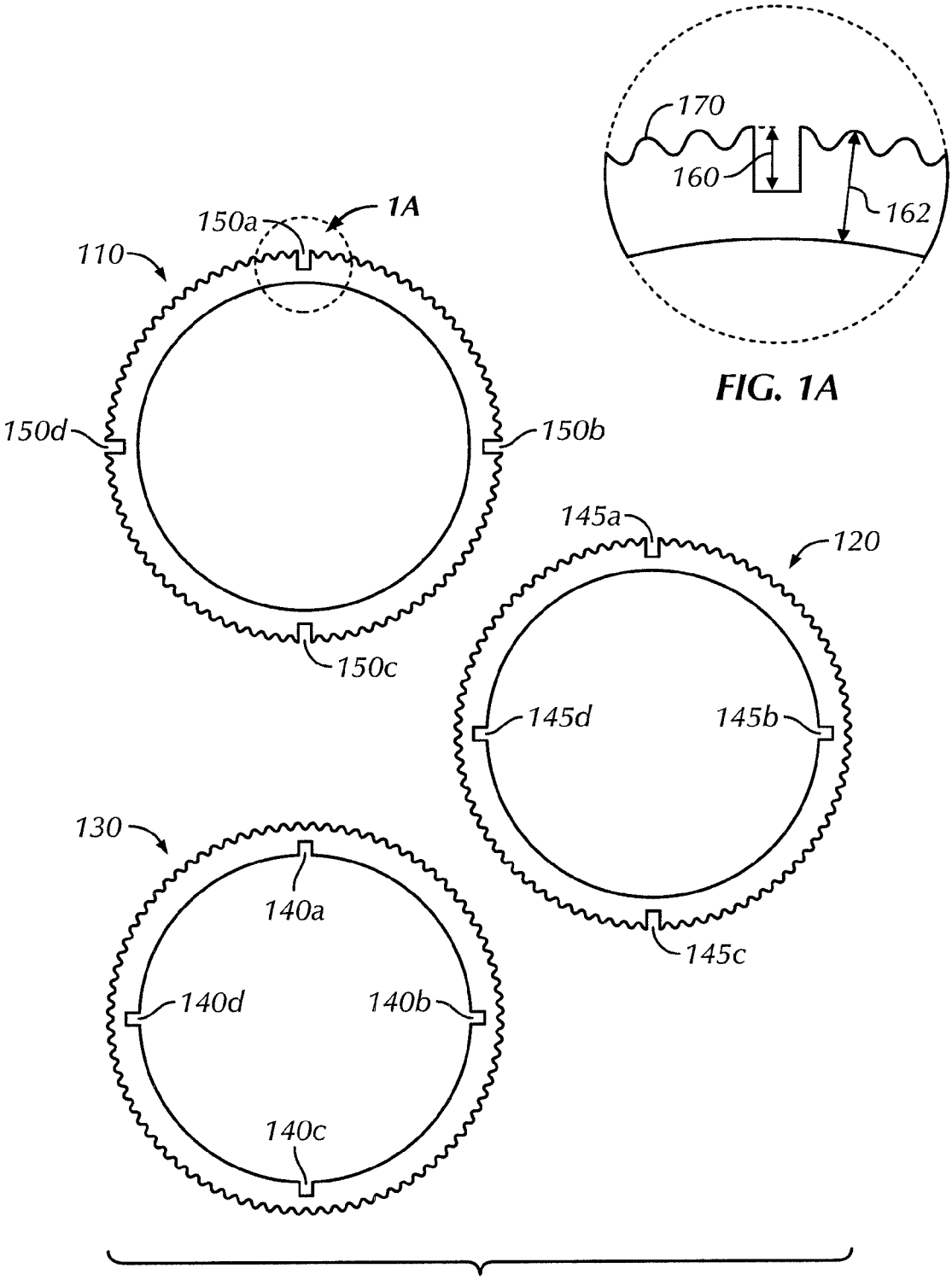
FIG. 1 depicts a spherical decorative light display in accord with one embodiment of the present invention.
FIG. 1A is a close-up view of a portion of the decorative light display of FIG. 1.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring to the drawings, and initially to FIG. 1 thereof, there is depicted a framework or interlocking structure 100 for a spherical decorative light display. The spherical decorative light display or interlocking structure 100 is made of three interlocking rings or circular substructures 110, 120, and 130. It will be appreciated that the substructure 110 may be identified as the inner substructure, the substructure 120 may be identified as the middle substructure, and the substructure 130 may be identified as the outer substructure. The substructures 110, 120, and 130 include notches 140, 145, and 150, which are used to lock the individual substructures 110, 120, 130 together. In the illustrated embodiment, the substructures 110, 120, and 130 are generally circular in shape and are locked together to form a spherical framework. Each substructure 110, 120, 130 has four equally spaced notches 140*a-d*, 145*a-d*, 150*a-d* formed therein. Each notch 140*a-d*, 145*a-d*, 150*a-d* is formed 90 degrees apart from the other on the substructures 110, 120, 130. Further, depending on the orientation and function of the substructure 110, 120, 130, the notches 140*a-d*, 145*a-d*, 150*a-d* may be on the outer or inner circumference or periphery of the substructure 110, 120, 130. In the depicted embodiment, the inner substructure 110 has notches 150*a-d* formed on the outer circumference thereof, the middle substructure 120 has notches 145*a-d* formed on both the outer and inner circumferences thereof, and the outer substructure 130 has notches 140*a-d* formed on the inner circumference thereof. It is to be noted that the substructure 120 has two inner notches 145*b,d* formed on the inner circumference thereof, and two outer notches 145*a,c* formed on the outer circumference thereof.

In the illustrated embodiment, the notches 140*a,c* and 150*a,c* are preferably oriented 180 degrees apart. That is, the notches 140*a,c* can be considered to be positioned at the 0 degree and 180 degree positions, and the notches 150*a,c* can be considered to be positioned at the 90 degree and 270 degree positions on the substructure 120. It will be appreciated by those of skill that the notches 140*a-d*, 145*a-d*, and 150*a-d* may be placed at different angled locations on the periphery of the respective substructures depending upon the number of substructures used to construct the decorative light display. If a decorative light display employs four (4) or more substructures, then the associated notches would be positioned at corresponding angles thereon.

The notches 140*a-d*, 145*a-d*, and 150*a-d* are generally of a square or rectangular shape. Persons of skill in the art, however, will recognize that other shapes could be employed in the framework 100, such as an oval, an ellipse, a Christmas tree, and a cone. The dimensions or sizes of the notches 140*a-d*, 145*a-d*, and 150*a-d* vary as a function of the material used to from substructures 110, 120, 130. A variety of materials such as polymers, plastics, wood, composites, and recycled fiber can be used to form the substructures 110, 120, and 130. In one practical embodiment, the substructures 110, 120, and 130 were made from polyvinyl chloride ("PVC") or acrylonitrile butadiene styrene ("ABS") polymers. In such a practical embodiment, using PVC or ABS, the notch height 160 was approximately one half the depth of the height 162 of the substructure 110, 120, 130, i.e., the distance 162 from the inner circumference to the outer circumference of the substructure 110. In one practical embodiment, height 162 was about 1½ inches. As is apparent to one of ordinary skill in the art, the notch height 160 must leave sufficient material on the substructure 110, 120, 130 so that the substructure 110, 120, 130 is strong enough to withstand the flexing forces applied thereto during assembly and disassembly of the decorative display 100, as described more fully hereinbelow in connection with FIGS. 7 to 9, without being too thin and thereby sacrificing structural strength. Sufficient material must remain on the substructure 110, 120, 130 to provide sufficient structural strength to the spherical decorative light display 100 once the spherical decorative light display 100 is fully assembled, i.e., sufficient structural strength so that the decorative light display 100 maintains the desired shape once assembled and does not collapse in use.

The thickness of the substructures 110, 120, and 130 determines the overall stiffness and rigidity of the spherical decorative light display 100. If, for example, the substructures 110, 120, 130 are too thick, then the spherical decorative light display 100 becomes too stiff to assemble. If, on the other hand, the substructures 110, 120, 130 are too thin, the substructures 110, 120, 130 will fail during assembly or will not support the light string or strand disposed thereon. (See FIG. 4.) If substructures 110, 120, 130 are too thin, substructures 110, 120, 130 fail after only a few assemblies and disassemblies, thus exhibiting an undesirably short life span. In one practical embodiment, the spherical decorative light display 100 was made from PVC or ABS and had a thickness of about 0.15 inches to about 0.35 inches, and preferably had a thickness of about 0.19 inches to about 0.31 inches. In another practical embodiment having a 32 inch diameter for the substructures 110, 120, 130, the thickness was from about 0.5 to about 0.75 inches.

Figure 4:
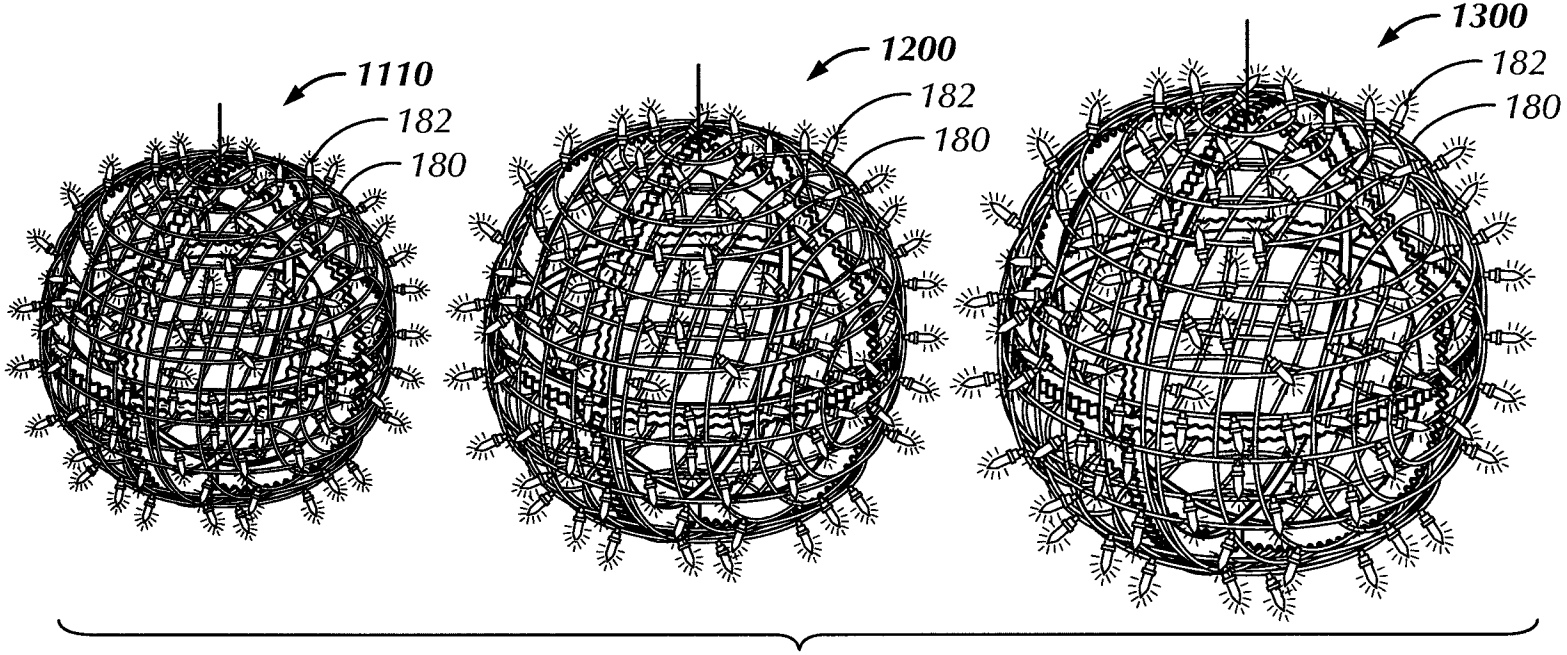
FIG. 4 depicts an assembled spherical decorative display in accord with one embodiment of the present invention.

The substructures 110, 120, and 130 include a wavy or toothed design or shape 170 on the outer circumference thereof. The wavy or toothed shape creates a surface that retains or secures the light strand wires 180 thereto, and yet prevents the light strand wires 180 from bunching together when the light strand wires 180 are wrapped around the spherical decorative light display or framework 100 formed by the interlocked substructures 110, 120, 130. The light strand wires 180 are retained on the wavy surface 170 of the substructures 110, 120, 130 using the tension force of the light strand wires 180. It will be appreciated by those of skill in the art that no other mechanical retention device or mechanism, such as a clip or the like, is needed to secure the light strand wires 180 in contact with the outer circumference of the substructures 110, 120, 130. As illustrated in FIG. 4, the light strand wire 180 is wrapped around the substructures 110, 120, 130 whereby the wavy or toothed shape 170 engages the light strand wire 180 and prevents the same from sliding or falling off the substructures 110, 120, 130.

Figure 10:
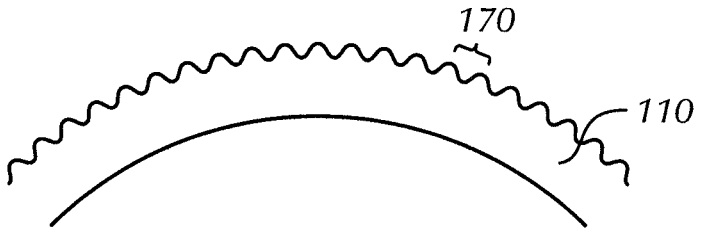
FIG. 10 depicts a sinusoidal wave form surface of a framework in accord with the present invention.
Figure 11:
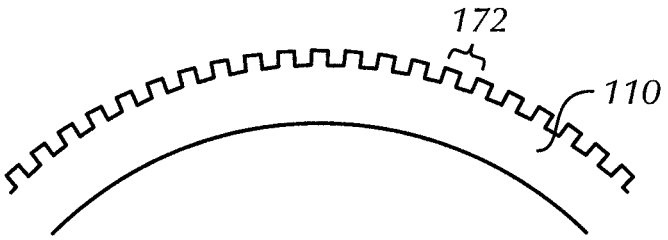
FIG. 11 depicts a square wave form surface of a framework in accord with the present invention.
Figure 12:
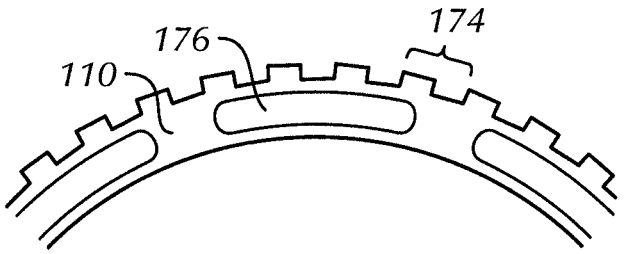
FIG. 12 depicts a rectangular wave form surface of a framework in accord with the present invention.

Any wavy shape 170 may be utilized in the present invention, or a combination thereof. In the preferred embodiment, a sinusoidal wave shape 170 (see FIG. 10) is formed in the substructure's 110, 120, 130 outer circumference. It will be appreciated that the amplitude and frequency of the sinusoidal function must be carefully selected. If the amplitude or the frequency of the wavy shape 170 is too large, the light strand 180 will bunch together at the bottom of the substructure 110, 120, 130. If the amplitude or frequency of the wavy shape 170 is too small, there may not be sufficient force to retain the light string 180 in contact therewith. Other designs, such as a square wave 172 (see FIG. 11) or a rectangular wave 174 (see FIG. 12), may be used, but must have sufficient dimensions to prevent the light strand 180 from bunching together while providing sufficient force to retain the light strand 180 in contact with the substructures 110, 120, 130.

It will be appreciated that the substructures 110, 120, 130 may be formed with pockets or grooves 176 therein. The pockets 176 are formed so as to reduce the material used in the fabrication thereof, and therefore, reduce the costs of production. Additionally, when the substructures 110, 120, 130 are formed by an extrusion process, the substructures 110, 120, 130 cool down faster when the pockets or grooves 176 are formed therein. This also permits faster production of the substructures 110, 120, 130.

Figure 2:
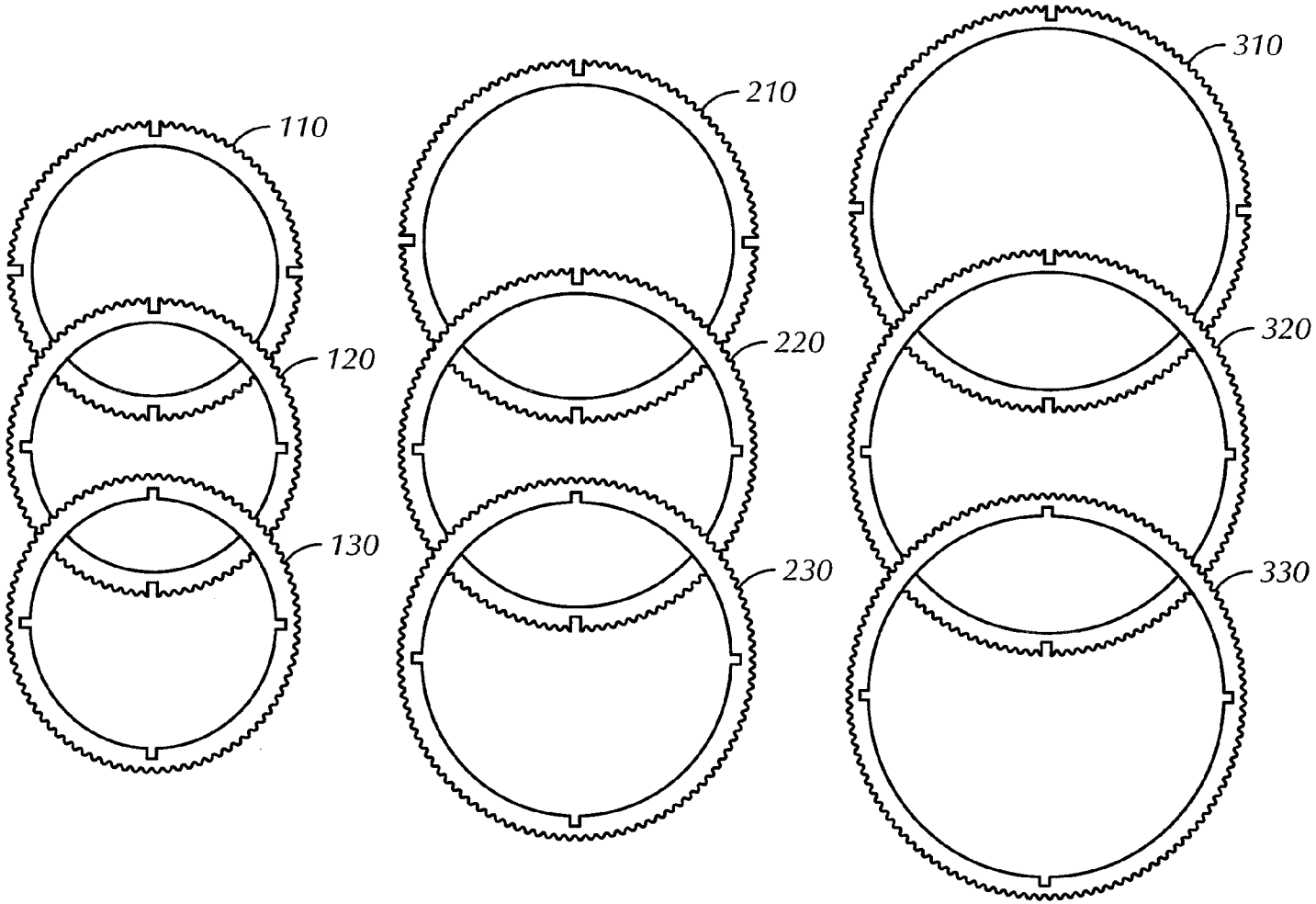
FIG. 2 depicts three different spherical decorative light displays, each of a different diametrical dimension.
Figure 3:
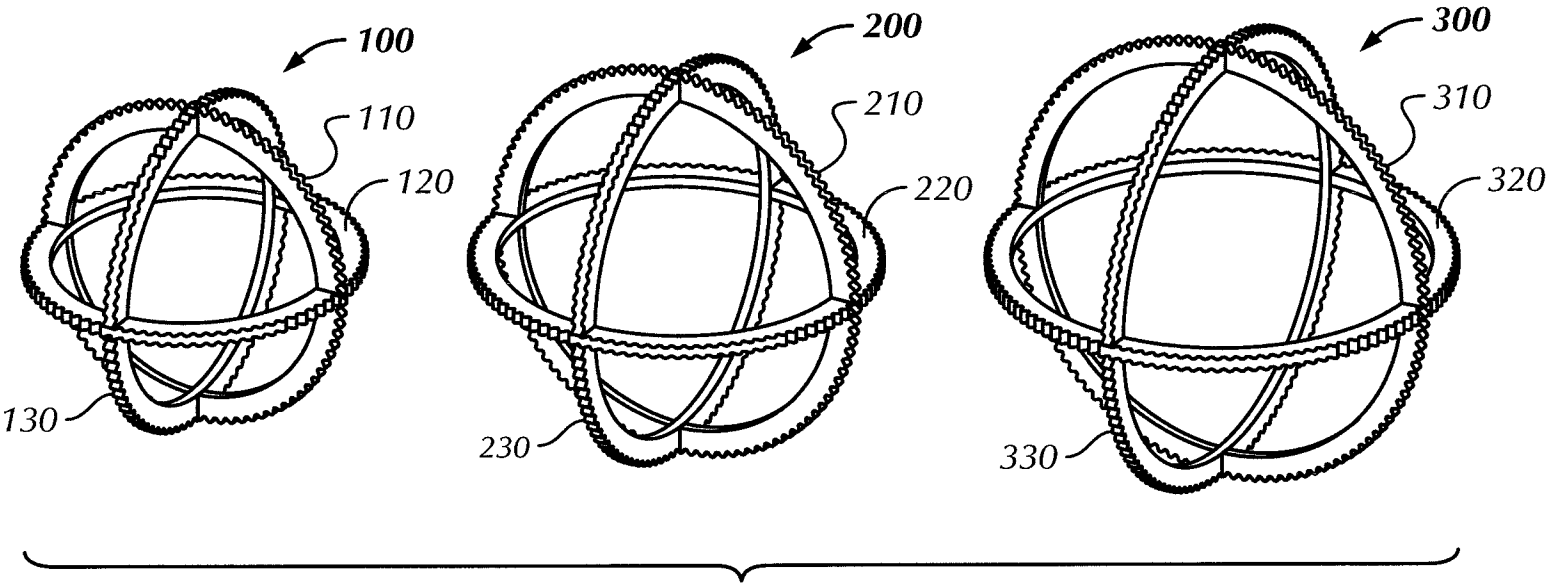
FIG. 3 depicts an assembled spherical decorative framework.

The substructures 110, 120, 130 may be of various dimensions or diameters depending upon the desired shape of the decorative light display 100. FIG. 2 shows interlocking substructures 110, 120, 130, 210, 220, 230, 310, 320, and 330, having three different internal diameters, thus forming three differently dimensioned spherical decorative frameworks 100, 200, 300. FIG. 3 illustrates the interlocking substructures 110, 120, 130, 210, 220, 230, 310, 320, and 330 assembled to from three spherical frameworks 100, 200, and 300. FIG. 4 shows interlocking substructures that have been assembled and are covered or wrapped with the light strand wires 180 secured thereto to form spherical decorative displays 1100, 1200, 1300. The light strand wires 180 include light bulbs 182 for illumination.

Figure 5:
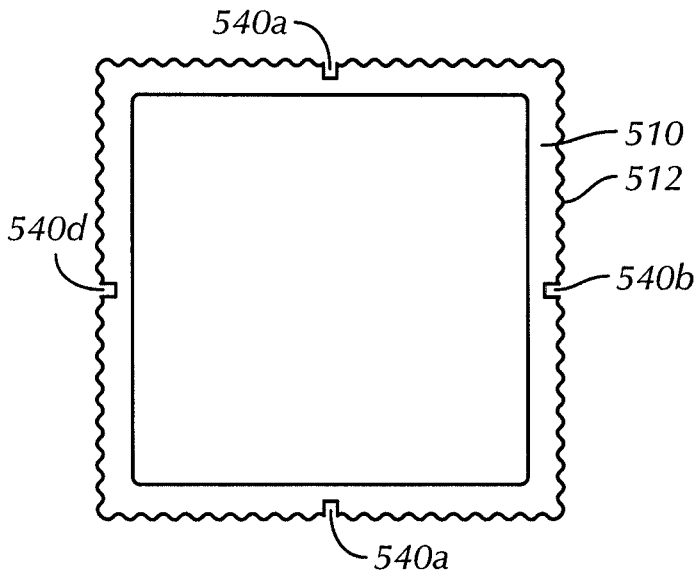
FIG. 5 depicts a cube-shaped decorative light display in accord with an alternate embodiment of the present invention.
Figure 6:
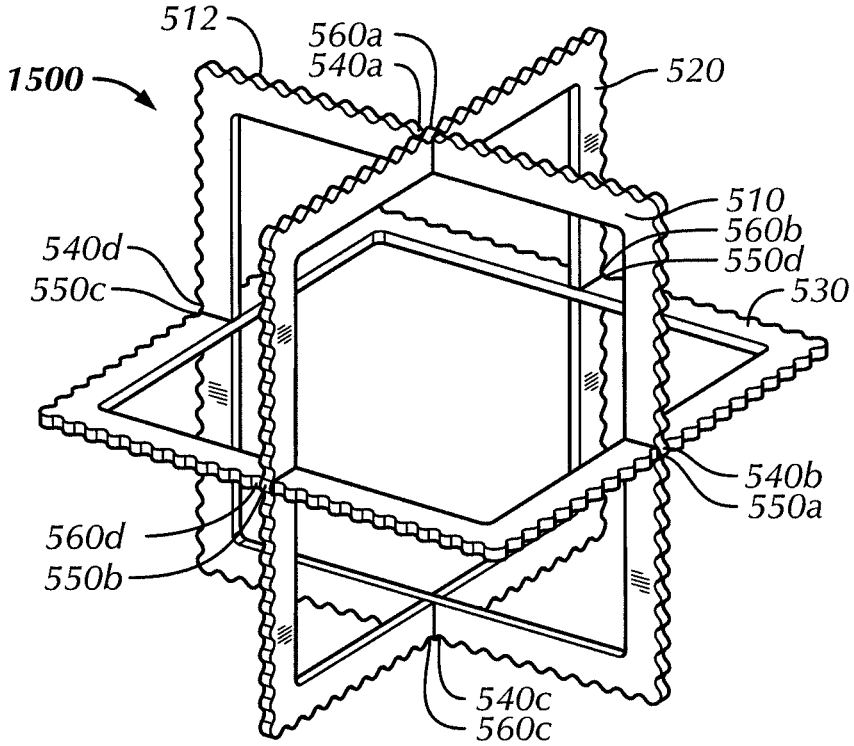
FIG. 6 depicts an assembled cube-shaped decorative light display in accord with the embodiment of FIG. 5.

It will be appreciated by those of skill in the art that other decorative display shapes may be formed. The shape may be, for example, a sphere, a cube, or a cone. FIG. 5, for example, illustrates an inner substructure 510 that is used to form a cube-shaped decorative display 1500 (see FIG. 6). As in the case of the previous embodiments utilizing the circular-shaped substructures 110, 120, 130, discussed hereinbefore, the substructure 510 is formed with a wavy surface shape or tooth 512 and notches 540*a-d* positioned on the outer periphery thereof. FIG. 6 depicts a decorative display 1500 having a generally cube-shaped configuration assembled from three square substructures 510, 520, and 530. The substructure 510 may be considered as an outer substructure, the substructure 520 may be considered a middle substructure, and the substructure 530 may be considered an inner substructure. The substructure 530 includes a wavy surface shape or teeth 512 and notches 550*a-d* on the inner periphery thereof. The middle substructure 520 also has a wavy surface shape or teeth 512 and notches 560*a-d* on its inner and outer peripheries. While not shown, other design shapes, such as spheroid, conical, cylindrical, etc., may also be formed.

Figure 7:
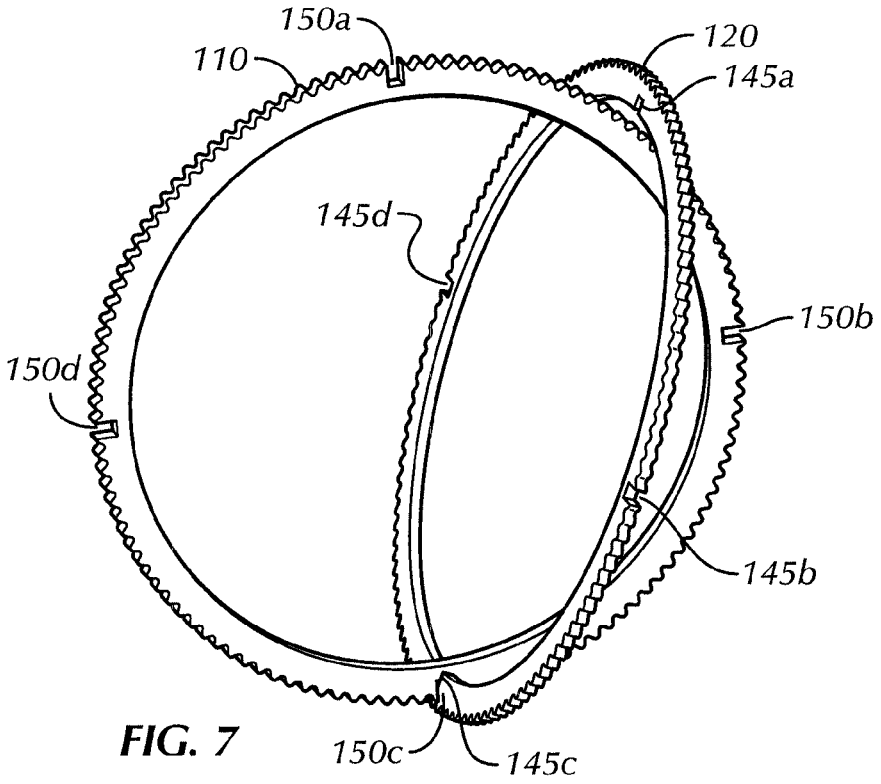
FIGS. 7 to 9 depict the assembly of a spherical decorative light display in accord with the present invention.
Figure 8:
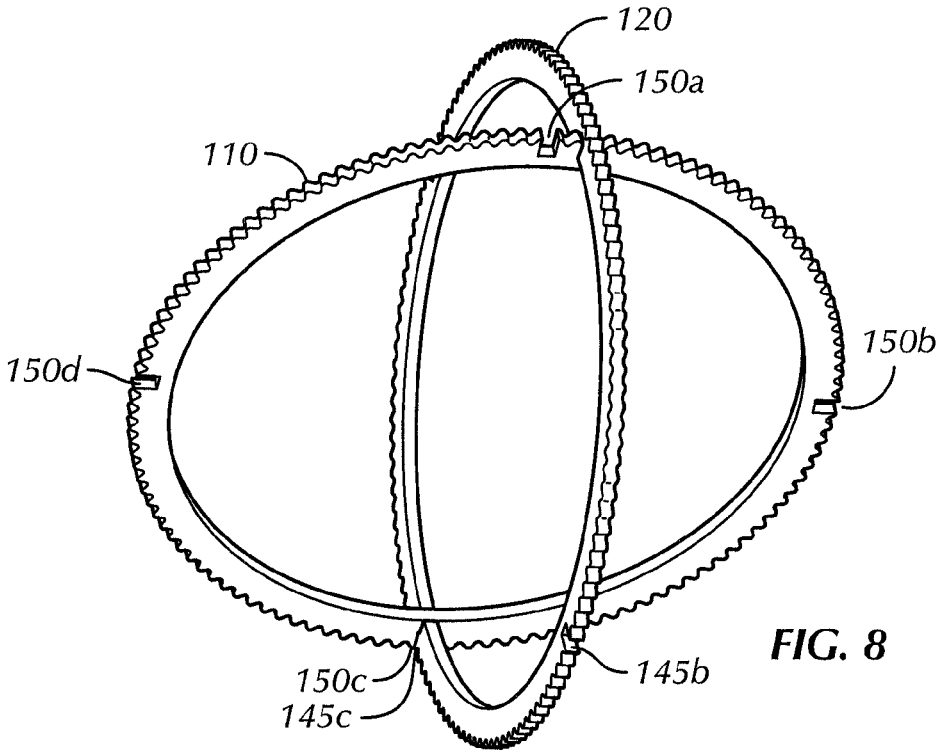
Figure 9:
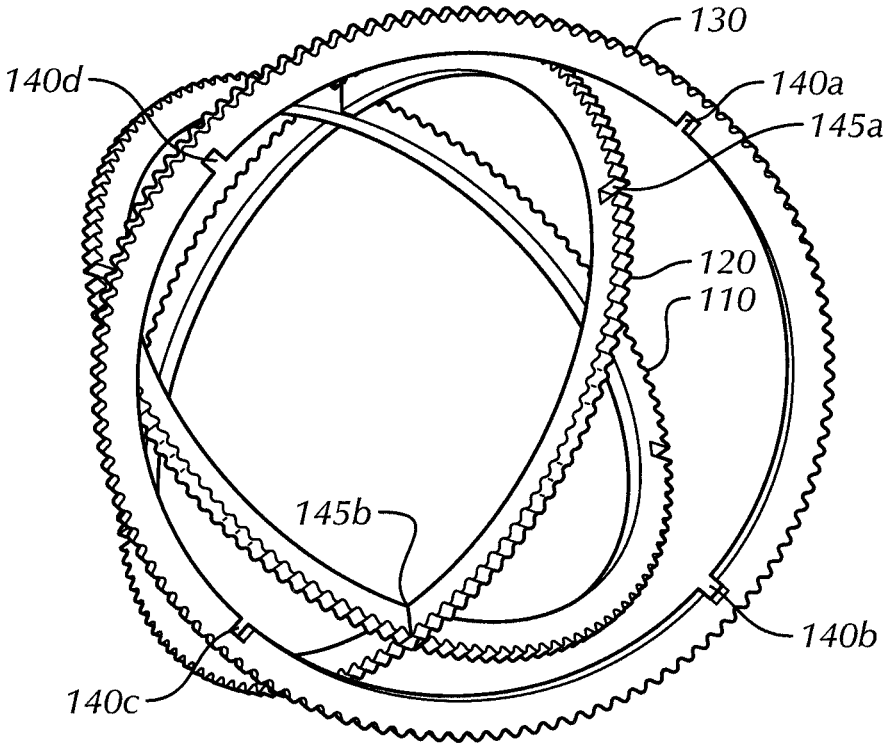

FIGS. 7 to 9 illustrate a method of assembling a decorative light display or interlocking structure 100 according to the present invention. FIG. 7 depicts the assembly of the inner substructure 110 and the middle substructure 120. The outer notch 150*a* disposed on the inner substructure 110 is mated with the inner notch 145*a* on the middle substructure 120. As shown in FIG. 8, the substructure 120 is then flexed, stretched or pulled over the outer circumference of the inner substructure 110 until the second inner notch 145*c* of substructure 120, opposite the first inner notch 145*a*, is mated with the second outer notch 150*c* of the substructure 110. It will be appreciated that the second outer notch 150*c* is opposite the first outer notch 150*a*. After the inner substructure 110 and the middle substructure 120 are interlocked, the outer substructure 130 is added to the assembly, as depicted in FIG. 9. One inner notch 140*a,c* on the outer substructure 130 is mated with an outer notch 145*a,c*, 150*a,c* on either the middle substructure 120 or the inner substructure 110. The outer substructure 130 is then flexed, pulled or stretched to allow the other notches 145*a,c*, 150*a,c* to mate with the remaining notches on both the inner substructure 110 and the middle substructure 120. As discussed hereinbefore, the selection of the materials of the substructures 110, 120, 130 dictate the thickness of the substructures 110, 120, 130 as necessary to allow the substructures 110, 120, 130 to flex during assembly or disassembly, but provide the necessary rigidity to support the light strand wires 180.

Once the substructures 110, 120, 130 are interlocked, thus forming the framework of the decorative display 100, the light strand wires 180 are wrapped around the framework to create the completed decorative display 100. It will be appreciated from the above that the decorative display 100 may be disassembled by reversing the steps hereinbefore described, and the decorative display 100 will be compact and ready for storage.

It is envisioned that the present invention may be manufactured from plastic material on a Computed Numerically Controlled Machine ("CNC") machine, such as a CNC laser cutting machine, a CNC water jet cutting machine, a CNC router or the like. Injection molding, vacuum molding, or similar forming methods will also be suggested to those of skill in the art. Additionally, the invention may also be constructed by hand using a band or jig saw or a hand router. As noted hereinbefore, the interlocking structures 110, 120, 130 may be manufactured using PVC or ABS polymers. The structures may also be made from any polymer, plastic, wood, or composite material, as well as recycled fibers such as fiber board, all as desired by persons of skill in the art.

It will be appreciated that the method and structure of the present invention provide unique advantages over known art displays. The structures are easily assembled, disassembled and stored, and the light strand wires 180 may be easily attached, repaired and removed. It will also be appreciated that other decorative strings or strands may be used in conjunction with the substructures 110, 120, 130, such as beads, ribbons, garlands, Mylar sheets or the like that do not necessarily emit light, and the invention would function in the above-described manner just as it does with the light strand wires 180. In addition, a light may be placed within inner substructure 130, with Mylar sheets disposed on substructures 110, 120, 130, forming a lamp-like light source.

The foregoing description of embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A display for a decorative strand comprising:

at least one outer flexible substructure and one inner flexible substructure, said outer and inner flexible substructures comprising continuous strips of flexible material of substantially the same size and shape, each substructure having an outer dimension and inner dimension, said outer and inner dimensions of said flexible substructures including an interlocking mechanism that is configured for allowing said substructures to be assembled together to form a three-dimensional framework with the outer dimensions being substantially coextensive with each other, the flexible substructures being of sufficient shape and flexibility for the inner and outer substructures to be assembled together in a fixed relationship relative to each other and of sufficient shape and rigidity for the three-dimensional framework to stand on its own and support decorative strand wires mounted thereon, the outer dimensions of said flexible substructures further including a surface that is shaped to retain said decorative strand of wires on the outer surfaces of said flexible substructures.

2. The display of claim 1; wherein said interlocking mechanism comprises a pair of interlocking notches formed on cooperating surfaces of said flexible substructures.

3. The display of claim 2; wherein said inner and outer dimensions have inner and outer circumferences; wherein said flexible substructures comprise an inner flexible substructure and an outer flexible substructure; and wherein said notches are formed on said inner circumference of said outer flexible substructure and said outer circumference of said inner flexible substructure.

4. The display of claim 3; wherein said notches on each of said flexible substructures are formed 180 degrees from each other.

5. The display of claim 2; wherein said flexible substructures have a width dimension; and wherein said notches formed in said flexible substructures are about ½ of said width dimension.

6. The display of claim 2; wherein said flexible substructures have a thickness dimension; and wherein said thickness dimension is in the range of about 0.15 inches to about 0.75 inches.

7. The display of claim 2; wherein said decorative strand is selected from the group consisting of a string of lights, a garland, a string of beads, and a ribbon.

8. The display of claim 1; and further comprising a third flexible substructure disposed between said inner flexible substructure and said outer flexible substructure.

9. The display of claim 8; wherein said notches on each of said flexible substructures are formed 90 degrees from each other.

10. The display of claim 9; wherein said third flexible substructure includes notches formed on the inner and outer circumferences thereof.

11. The display of claim 10; wherein said notches formed on said inner circumference of said third flexible substructure are disposed to cooperate with said notches formed on said outer circumference of said inner flexible substructure, and said notches formed on said outer circumference of said third flexible substructure are disposed to cooperate with said notches formed on said inner circumference of said outer flexible substructure.

12. The display of claim 1; wherein said flexible substructures are made of a material selected from the group consisting of polymers, plastics, wood, composite material, recycled fibers, and fiber board.

13. The display of claim 1; wherein said flexible substructures have outer circumferences; and further comprising a wavy design formed on said outer circumferences for contacting said decorative string.

14. The display of claim 13; wherein said wavy design is selected from the group consisting of a sinusoidal wave shape, a rectangular wave shape, and a square wave shape.

15. The display of claim 1; wherein said flexible substructures have a generally circular shape.

16. The display of claim 1; wherein said flexible substructures have a generally square shape.

17. A structural framework for a decorative display, comprising:

at least first, second and third flexible substructures comprising continuous strips of flexible material of substantially the same size and shape and having outer surfaces defining an outer dimension for each of the substructures, and inner surfaces defining an inner opening for each of the substructures;

said flexible substructures being sized so that one of the substructures is an outer substructure and the second and third substructures are inner substructures, said substructures having sufficient structural strength and flexibility such that the substructures can be assembled one within another in a fixed relationship relative to each other to form a three-dimensional framework with the outer dimensions of the substructures being coextensive with each other, so that when adjacent substructures are interlocked together, the substructures will maintain their desired shape and form a structural framework and support decorative display wires mounted thereon;

the outer dimensions of said flexible substructures further including a surface that is shaped to retain said decorative display wires on the outer surfaces of said flexible substructures.

18. The structural framework of claim 17, wherein said flexible substructures comprise interlocking mechanisms in the form of interlocking notches formed on cooperating surfaces of said flexible substructures.

19. The structural framework of claim 17, and further comprising a plurality of protrusions formed on said substructures for contacting a light string.

20. The structural framework of claim 19, wherein said protrusions comprise a wavy surface.

21. The structural framework of claim 20, wherein said wavy surface is selected from the group consisting of a sinusoidal wave shape, a rectangular wave shape, and a square wave shape.

* * * * *